United States Patent [19]

Balzer

[11] Patent Number: 4,756,645

[45] Date of Patent: Jul. 12, 1988

[54] SUPPORT STRUCTURE, PROCESS FOR PRODUCING THIS SUPPORT STRUCTURE, MEANS FOR PRACTICING THE PROCESS

[76] Inventor: Edmond H. M. Balzer, 42, Allées Francois-Verdier, 31000 Toulouse, France

[21] Appl. No.: 877,426

[22] Filed: Jun. 23, 1986

[30] Foreign Application Priority Data

Jul. 1, 1985 [FR] France ..... 85 10380

[51] Int. Cl.[4] ..... E02D 29/02

[52] U.S. Cl. ..... 405/284; 405/258; 405/286

[58] Field of Search ..... 405/258, 262, 272, 284, 405/285, 286, 287

[56] References Cited

U.S. PATENT DOCUMENTS 918,046 4/1909 Hartnagel ..... 405/284
3,421,326 1/1969 Vidal ..... 405/284
4,306,393 12/1981 Shelton .

FOREIGN PATENT DOCUMENTS 890859 2/1982 Belgium .
7904901 12/1980 Netherlands .

*Primary Examiner*—David H. Corbin
*Attorney, Agent, or Firm*—Young & Thompson

[57] ABSTRACT

A built-up roadway formed on a cut in a hillside comprises a stack of layers of loose material, each layer being at least partially enveloped by a sheet of geotextile fabric. A vertical wall is disposed facing the exposed side of the stack, and spaced therefrom. The wall serves to shield the geotextile fabric from exposure to ultraviolet radiation without directly bearing the weight of the stack. In a preferred embodiment, a portion of the stack rests on the base of the vertical wall, such that the wall is stabilized by the stack. A method for making this built-up roadway comprises mounting the geotextile fabric on a casing plate that is wedged into the space between the stack and the wall, unrolling the fabric from the casing plate onto underlying loose material forming successive layers, and unwedging and repositioning the casing plate at a higher level to form a vertically superposed subsequent layer.

12 Claims, 6 Drawing Sheets

Figure 1:
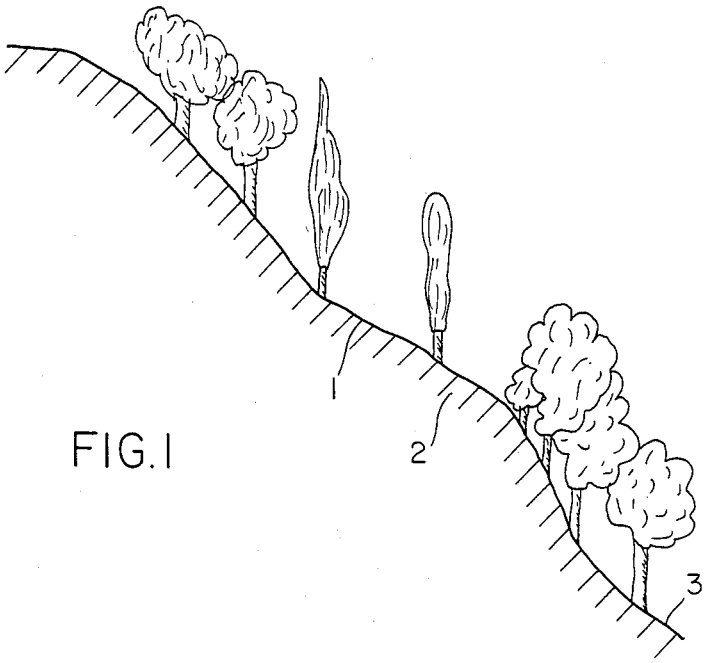

FIG.4A
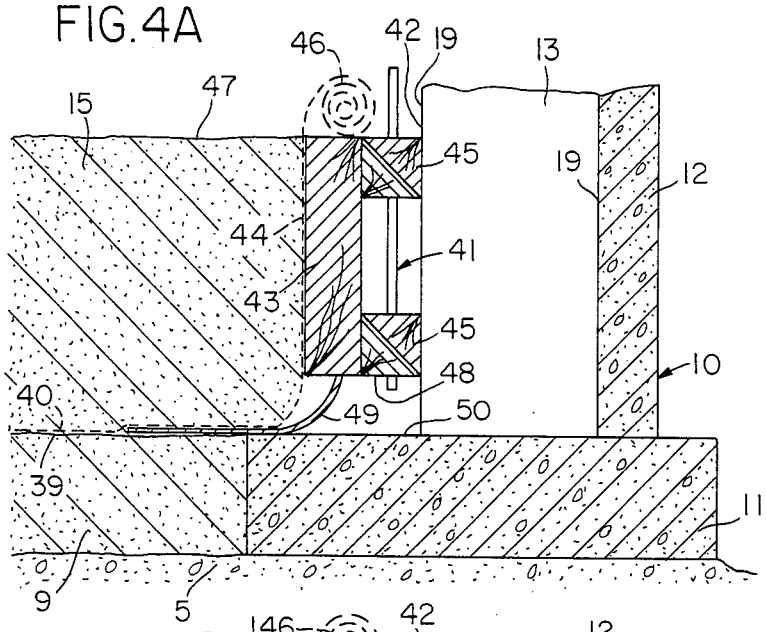
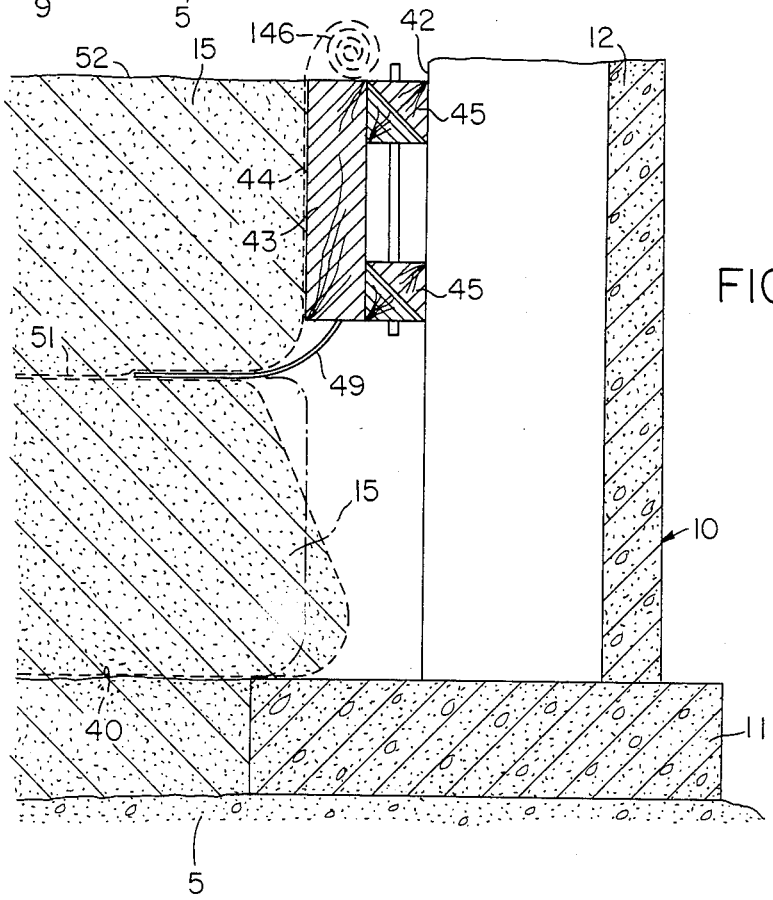
FIG.4B

SUPPORT STRUCTURE, PROCESS FOR PRODUCING THIS SUPPORT STRUCTURE, MEANS FOR PRACTICING THE PROCESS

The present invention concerns support structures, processes for producing these structures and means for practicing these processes.

When it is necessary to create a built-up roadway support structure, the known techniques offer numerous solutions. Besides the known solutions in masonry, concrete, reinforced concrete, the equilibrium of which is assured by the connection of the vertical part of the product with its foundation, or entirely by its own weight resting on a hard ground, there have for several years existed systems consisting in directly assuring the stability of the "built-up roadway - rear embankment" assembly by creating a ground stabilization by the incorporation, in the prepared ground, of foreign bodies resistant to traction.

There is thus a first system called "reinforced earth" which assures the stability by layers of metallic sheet connected to reinforced concrete shells which form the built-up roadway, these shells resting on the section, or the side of the ground. A second system consists in piling layers of earth on top of one another, a special fabric called "geotextile" by technicians being spread out at the boundary of each layer and returned to the visible extremity of the structure, so as to form an envelope and, at the same time, the lateral retaining wall of the structure. There is thus obtained a series of entirely self-stable layers or envelopes. This technique is economical as it permits using a filling or loose earth as the majority of the material. Its development is retarded at present by the difficulty in effecting a built-up roadway with this method.

Specifically, when it is possible to incline this retaining wall, at least its exterior side, sodding of the face permits resolving the protection problem, the geotextiles being protected by the soil and thus protected from ultraviolet radiation. In fact, these fabrics are very sensitive to ultraviolet radiation and this latter may cause their decomposition. On the contrary, in the case where it is sought to realize a vertical retaining wall, two problems arise: first, the difficulty in effecting the piling up of the layers of soil onto each other vertically, as their extremities are sometimes difficult to retain, second, the difficulty in preparing the protection of the geotextiles at their exterior vertical extremities and of disposing at the upper part of the piling, a road surface or another product which extends up to the edge of the built-up roadway. In fact, no solution has been truly satisfactory. That is why this system of layers with geotextile fabrics has a limited use.

Thus, the present invention has as an object to produce a support structure of the type enveloped by geotextile fabrics which allows obtaining a built-up roadway and which may receive, at its upper part, road surfaces, tracks, etc. . . . , which may extend up to the lateral edge of this support.

More precisely, the present invention has as an object a support structure adapted to be erected on a relatively horizontal ground surface, characterized by the fact that it comprises:

a stack of a plurality of layers of loose material, the said layers being disposed on top of each other, a flexible envelope at least partially surrounding each said layer, the said stack being disposed on the said ground such that, at least the edges of the said layers, on one side of the said stack, are situated substantially in a first substantially vertical plane, a support wall disposed via a base on the said ground, substantially parallel to the said side of the said stack contained in the said first plane, the top of the said wall being at a level substantially higher than the top level of the said stack, a free space being provided between the said side of the said stack and the face of the said support wall turned toward the said stack.

The present invention also has as an object to practice a process for producing the support structure as described above and means for practicing the process for producing this support structure.

Figure 2:
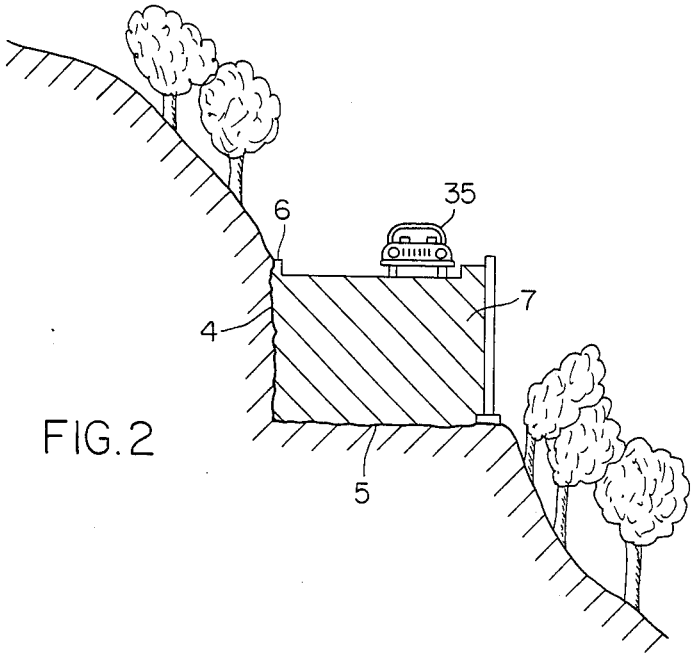
Figure 3:
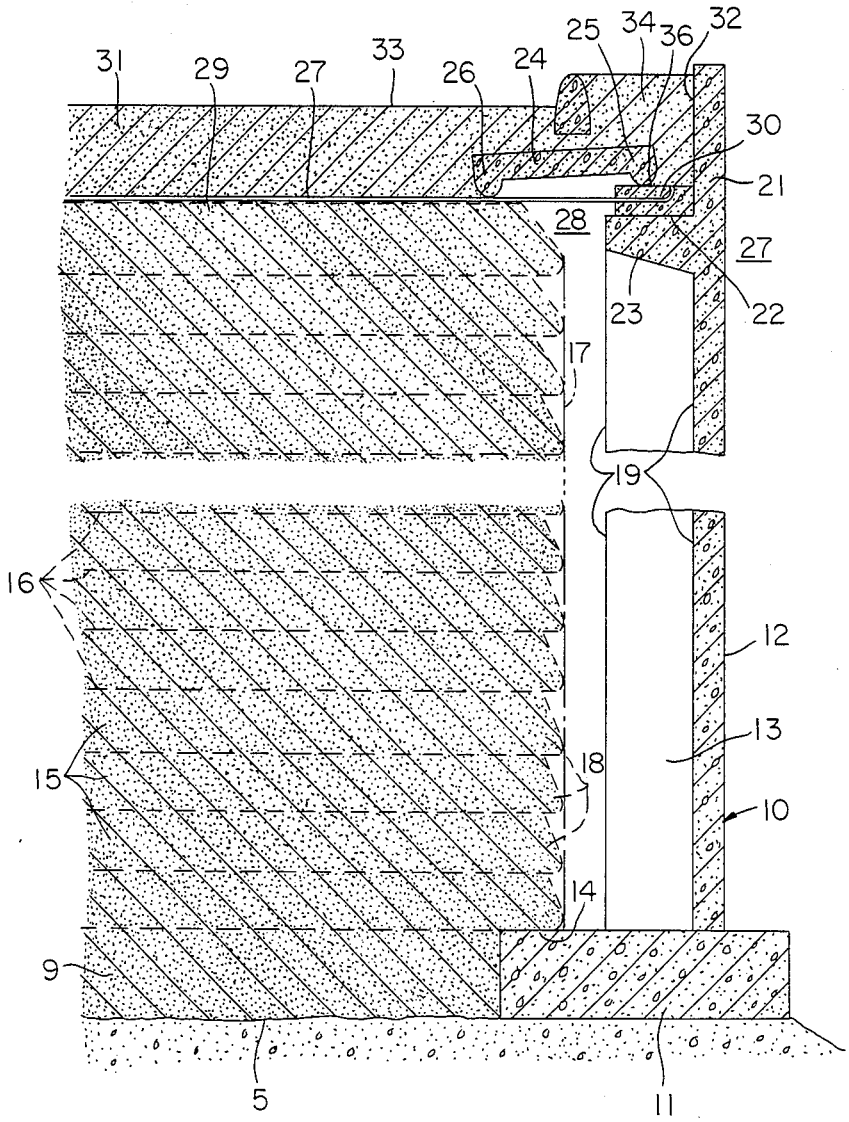
Figure 5A:
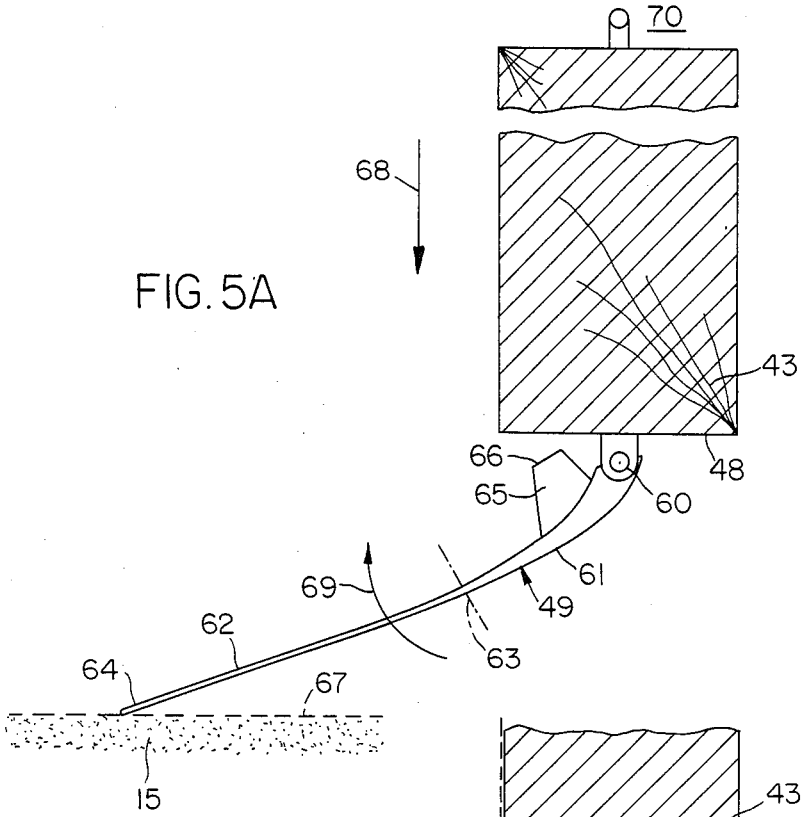
Figure 5B:
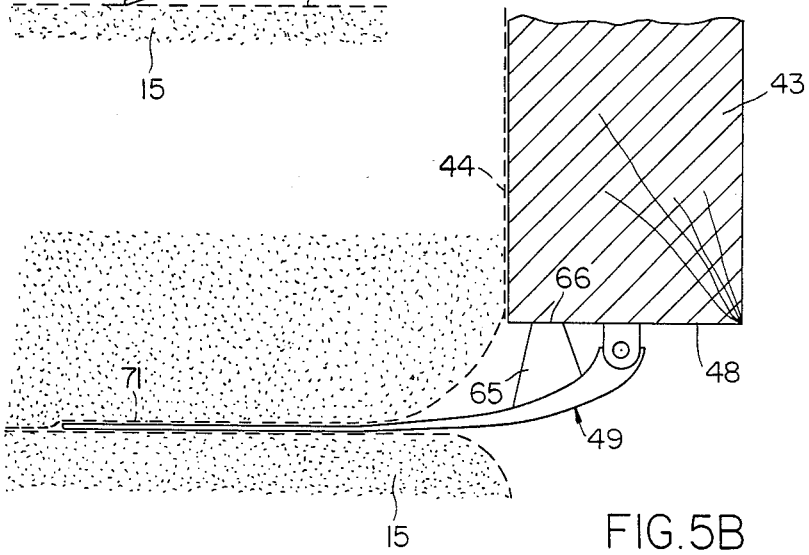
Figure 6A:
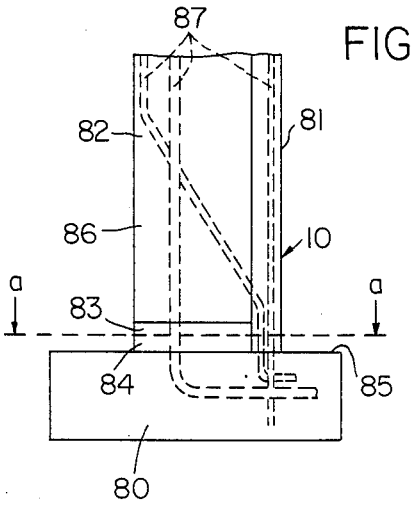
Figure 6B:
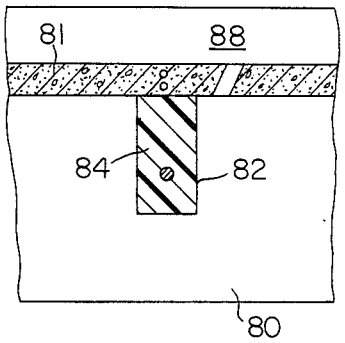
Figure 7A:
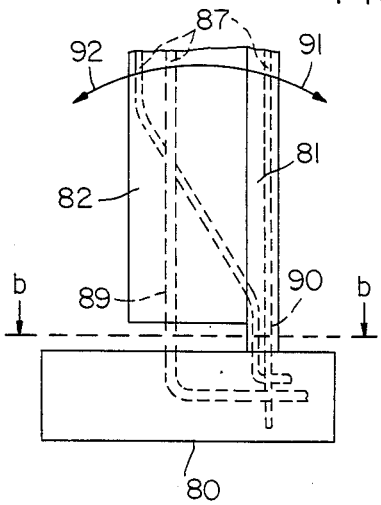
Figure 7B:
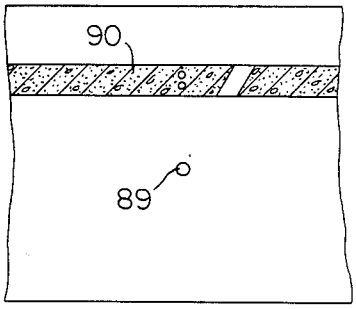
Figure 8:
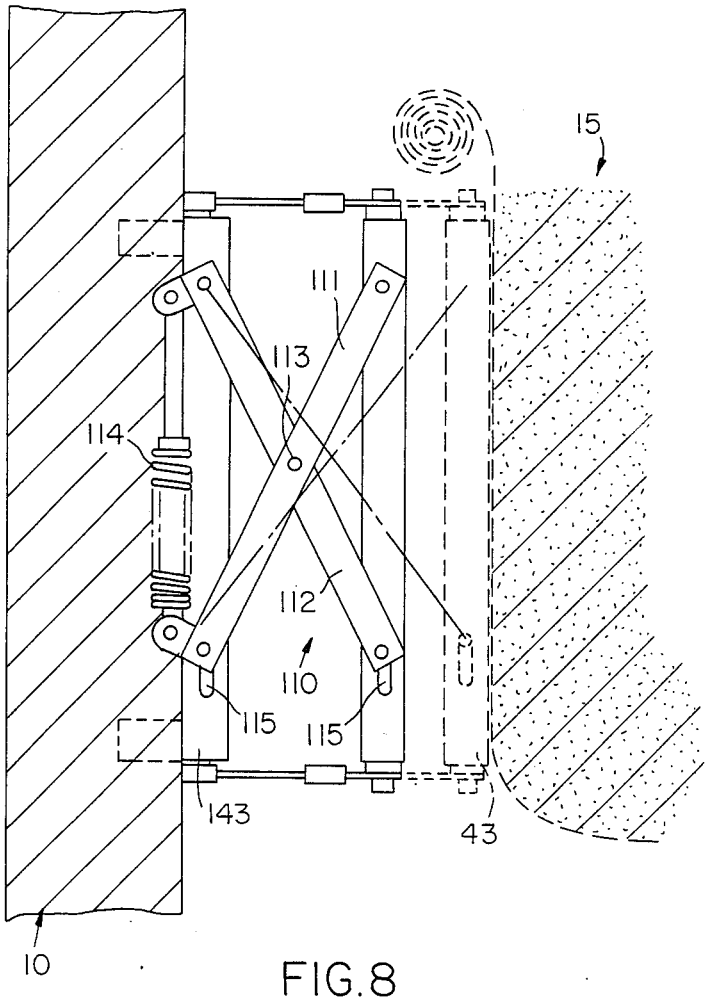

Other characteristics and advantages of the present invention will appear from reading the following description given with regard to the accompanying drawings by way of illustrative but non-limiting example, in which:

FIG. 1 shows a ground configuration on which a support structure according to the invention may be erected, FIG. 2 shows the configuration of the ground according to FIG. 1, after having received a support structure, particularly according to the invention, FIG. 3 shows a sectional view of a support structure according to the invention in application to a road, FIGS. 4A and 4B show two views permitting understanding of the practicing of the process for producing a support structure according to the invention as shown, particularly, in FIG. 3, FIGS. 5A and 5B show two illustrative diagrams permitting understanding of a particular stage of the process, as well as a part of the structural characteristics of means permitting practicing the process, FIGS. 6A and 6B show, respectively in two front and side views, this latter being a section taken along line a—a of FIG. 6A, one of the means permitting practicing the process and a structure of the support structure at a given step of the process, FIGS. 7A and 7B show, in two views corresponding to FIGS. 6A and 6B, the same means as in these latter figures, but at a later step than that illustrated in FIG. 6, FIG. 7B being a section taken along line b—b of FIG. A, FIG. 8 shows a schematic view of an element permitting practicing the process according to the invention, in this case with wedging means.

Referring more particularly to FIG. 1, this shows in section the surface 1 of a ground 2 having a relatively substantial slope 3, such a surface generally being found in the mountains.

When it is necessary to effect a mountainside road on such a surface 1, it is not possible to do so directly. Thus, there exist several solutions. A first consists in effecting pilings on the side of this mountain, and, above these pilings, constructing a support surface constituting the road. This first solution has indisputable disadvantages, as it is relatively costly, and what is more, may be dangerous, because of landslides which may thus carry away the pilings.

A second solution consists in cutting away the side of the mountain so as to effect a cut defined by two lateral walls, a horizontal wall and a vertical wall, as they appear respectively at 4 and 5 in FIG. 2. In these conditions, the road may thus be effected directly on the horizontal wall 5. But, in this case, it is necessary to guard against landslides which may arise from the wall 4, particularly by a retaining wall. This solution may be acceptable. Nevertheless, the retaining wall for the vertical lateral face which is necessary to effect must be very solid, so as to prevent it from being carried away by landslides, and also by the lateral pressure force exerted by the mass of earth disposed behind it.

A third solution consists in building up, by artificial means, the surface 5, to the highest level of the vertical wall 4. In this case, the surface of the road is disposed at the upper level 6 of the cut and all the filling 7 which is beneath the road must be retained so as to avoid a landslide. These support structures may be realized by a stack of earth as mentioned in the introduction of the present description, particularly with geotextile fabrics. Nevertheless, it is clear that the exterior lateral wall or built-up roadway of this filling may not be inclined as mentioned in the introduction. It is therefore very difficult to protect it from exterior influences, particularly ultraviolet radiation which causes its destruction by a polymerization of the geotextile tissues forming the envelopes of the loose layers.

Thus, the present invention has as an object to effect a support structure of the "layers enveloped by geotextile fabric" type having a natural protection and moreover having an ease of production, particularly up to the final construction of the road at the upper level.

Such a construction is shown in FIG. 3. In this figure a support structure referenced generally by 7 in FIG. 2 is shown partially in section. On the horizontal face 5 cut into the side of the mountain 2, is realized a first layer 9 called the "boundary layer" terminated by a support structure wall 10 comprising a base or seat 11 and a vertical wall 12 which may, if desired, comprise webs perpendicular to this wall.

Thus, when this wall 10 is erected, a plurality of layers 15 are stacked on the boundary layer 9 and on a part 14 of the base 11, the layers 15 being realized for example in a loose material such as soil, sand or landfill, enveloped by geotextile fabric 16. In this manner, the stacking of these layers 15 is limited laterally by a border disposed substantially in a vertical plane 17, the extremities 18 of the superposed stack layers being retained by the geotextile fabric 16.

Moreover, this stack of layers 15 is disposed at a certain distance from the interior surface 19 of the wall 10, so as to delimit, between its borders 18 and the surface 19 of the wall turned toward these borders, a space 20.

Advantageously, the support wall 10 has a height greater than that of the stack of layers 15, such that, substantially at the top 21 of this former, and particularly on a table 22 which may be supported by the top 23 of the web 13, support plates 24 may be disposed, one of the extremities 25 of which rests on the table 22 and the other extremity 26 on the top 27 of this stack of layers 15. These support plates 24 thus permit closing the space 20 at its top 28, thus entirely preventing the penetration of light rays to the solid products.

If desired, so as entirely to couple the top of this support wall 10 to the stack 15, metal wires or plates 29 may be coupled at the level of the table, for example cast in concrete and connected to bracing irons as illustrated schematically at 30, these wires next being disposed in and/or on the layers 15 so as to be gripped therein and thus completely retained.

Once this embodiment is obtained, above the stack of layers 15, material such as landfill, gravel or the like, tar is disposed in a layer 31 extending to the lateral edge 32 of the support wall 10, with, if desired, as shown in FIG. 3, a portion 34 slightly higher than the upper level 33 of the layer 31, this upper portion 34 being able to delimit, for example, a sidewalk bordering the surface 33 which serves as the road surface or rolling surface for vehicles as illustrated schematically at 35 in FIG. 2.

In this embodiment, it will be seen that from the very first the borders 18 of the layers 15 of the stack are completely protected from ultraviolet radiation, particularly by the wall 10 and the support plates 24 which prevent any possibility of penetration of solar light into the space 20, as well as solid foreign bodies. Moreover, these borders 18 are not placed in direct contact with the support wall 10, and more particularly with its interior surface 19, meaning that no lateral forces are exerted on this wall. Even if these layers 15 become compressed, which always occurs to a slight extent, they would not bear directly through their border 18 on the face 19 of the wall 10.

Moreover, the characteristic shape of the support plates 24, and particularly that of their two extremities 25 and 26 bearing respectively on the table 22 and the top 27, by rounded edges, permit a rotation of the support plate 24 when the stack of layers 15 becomes compressed. The rotation being effected through the point of contact 36 of the rounded extremity 25 of the support plate in direct contact with the table 22 of the support wall 10.

One of the additional advantages is that a portion of the stack of layers 15, more particularly the portion resting on the part 14 of the base 11, permits assuring a stability of the support wall 10, and thus prevents any possible tilting of this latter exteriorly.

Finally, it has been ascertained that the support wall 10 supports only very slight forces beyond those due to its own weight and to the part of the road 31 resting on its upper top, which is very little, and in no way supports all the mass of earth constituted by the stack of layers 15. Because of this, the support wall 10 may be formed of a light material, and thus at a relatively low cost.

In connection with FIGS. 1, 2, 3 there was described a support structure having advantages which were described above. Nevertheless, this structure has, moreover, the advantage of permitting practicing a process for producing this support structure, very easily compared to similar processes of the prior art.

FIGS. 4A and 4B show, in sectional views, two successive steps of the process for producing the support wall as shown in FIG. 3.

As mentioned previously, so as to produce a support structure according to the invention, there is produced starting from the horizontal surface 5 cut into the side of the mountain, a first layer, if desired also of concrete, called "boundary", 9, having a thickness substantially equal to that of the base 11 of the support wall 10. On this boundary layer is disposed, by unrolling, a first layer of geotextile fabric 40 that is mounted the length of a casing 41 which is positioned particularly with respect to the interior surface 19 of the support wall 10, and advantageously against the section 42 of the web 13 as previously described. This casing 41 is consituted by a first element forming a plate 43 having a planar surface 44 turned toward the layer 15 to be produced. This plate 43 is positioned with respect to the surface 42 by means of wedges that are slidable with respect to one another, this system comprising, as will be described later, the association of two wedges 45 situated at two different levels, namely at the top and bottom of the said plate 43.

Once this casing is produced, the geotextile fabric 40 is mounted the length of the surface 44 and wound above the casing, in anticipation of the production of the filling layer 15 of a predetermined thickness. When the thickness of this filling layer—loose earth, sand, gravel or other reclamation material—has attained the predetermined height, the geotextile fabric 40 placed in reserve at 46 is then unrolled on the surface 47 of the first-piled layer 15.

Moreover, as can be seen in FIG. 4A, the base 48 of the plate 43 consituted by a plank comprises a partially flexible plate 49 extending substantially from the middle of the lower surface 48 of this plate 43, to the upper surface 39 of the boundary layer 9, by being bent back, and thus permits the geotextile fabric to be well positioned the length of the surface 44 so as to prevent, when the first layer 15 is produced and compressed, the loose material from escaping between the face 48 of the plate 43 and the upper surface 50 of the base 11, and thus from coming in contact with the interior face 19 of the support wall 10.

When this layer 15 is finished and the surplus of geotextile fabric 46 has been unrolled on the surface 47 of the first layer 15, the two wedges 45 are deblocked so as to prevent the plate 43 from bearing against the lateral surface of the layer 15. A traction on this plate 43 may thus be exerted, causing it to slide upward. This is very easy to do, since the plate 49 is flexible and rests only on the layer 15 which does not have a great thickness, the weight which is exerted on this flexible sheet 49 thus not being substantial.

The plate 43 is then positioned at a higher level against the wall 19, and more particularly against the section 42 of the web 13, so as to produce a second layer, the flexible plate 49 being repositioned on the first-produced layer 15 and a second geotextile fabric 51 being unrolled on this first layer 15 and mounted the length of the surface 44 of the plate 43, in just the same manner as before. A second layer 15 is then disposed on the first layer 15 in the same manner as described previously, the surplus 146 of geotextile fabric being unrolled on the upper surface 52 of the second-formed layer 15.

It will thus be seen that at the time of this stacking of layers 15, there is exerted on the wall 10 only the lateral force due to the mass of a single layer of filling, the force transmitted by the casing, and only during the time of manufacture of a layer. Moreover, as these filling layers have a relatively slight thickness, the lateral forces to which the support wall 10 is subjected during production of the stacking of the layers 15 are rather slight. Consequently, the wall 10 need not be of a very heavy construction.

It will be understood that the successive layers 15 will be produced the ones against the others, as described above, by causing the casing to slide the length of the wall, with respect to its interior surface, and by providing to this effect the interior space 20 mentioned above.

There will therefore be seen the previously stated advantages of a production of support structure according to the invention, in particular, the presence of the space 20 which permits bringing to this construction lightness and ease of manufacture.

It will be understood that it is not always possible to produce very precise casings and, moreover, the persons who use these materials may be unable to use them in very favorable conditions. It is thus necessary to provide them with means which may be used without particular precautions. As mentioned above, the plate 43 of the casing 41 must therefore be positionable with public works devices which are above all rather difficult to manipulate.

Hence the plate 43, for example, is generally suspended from a crane, and brought down the length of the support wall to a position which must be determined in a relatively precise manner, but without requiring the particular attention of technicians. Also, the flexible plate 49 as described above, particularly with respect to FIG. 4, is constituted by a metallic element articulated about a hinge 60 by a thickened portion 61 and terminating in a narrowed portion extending toward its extremity 64, so as to impart to it a progressive elasticity by its decreasing width. This plate 49 is therefore relatively rigid on a portion 61 situated between the hinge 60 and its middle part referenced 63 in FIG. 5, its flexible portion 62 being situated substantially between this point 63 and the extremity 64.

Thus, by employing such a technique and by disposing on the rigid part 61 a defining projection 65 such as, for example, a trapezoidal portion the extremity 66 of which is adapted, during the course of rotation of the part 61 about the hinge 60, to be positioned on the surface 48, it is possible to define the final position of the plate 43 when it is brought down the length of the interior surface 19 of the wall 10.

Specifically, by bringing the element 43 downward toward the stack of layers 15, following a displacement indicated by the arrow 68, the extremity 64 of the flexible plate 49 may slide on the surface 67 of the upper filling layer 15, driving in clockwise rotation 69 the flexible plate 49, until it comes, through surface 66 of the projection 65, in contact with the lower surface 48 of the element 43. At this instant, the flexible plate 49 is perfectly positioned along with the element 43 in lower position, as shown in FIG. 5B. In this position, the element 43 may descend no further. It then suffices to unroll a new layer of geotextile fabric 71 and to mount it the length of the wall 44 of the element 43, as described particularly with regard to FIGS. 4A and 4B.

As shown in FIG. 3, the stack of layers 15 may, generally, be compressed. The packing may cause through the intermediary of the link 29, a traction on the upper extremity of the support wall, particularly the extremity 21, and thus cause a torsion of the wall tending to displace it interiorly, that is to say toward the stack. On the other hand, it will be understood that for various reasons the stack of layers 15 may tend not to compact, but to expand. Under these conditions, forces opposed to the above-mentioned traction are exerted on the upper extremity of the wall, which tend to cause it to withdraw from the stack of layers 15. It is clear that these different torsions, toward or away, as described above, may be produced during different seasons, for example due to rain, freezing and excessive heat. In this case, it is preferable to provide this support wall, and particularly its upright portion 12, with a certain flexibility at the level of its base which is connected to the base 11.

Referring more particularly to FIGS. 6A and 6B, 7A and 7B, these two figures show an embodiment of the support wall 10 as illustrated especially in FIG. 3.

Referring more particularly to FIGS. 6A and 6B, these show a support wall 10 with a base 80 on which is disposed a lateral, vertical wall 81 comprising, if desired, webs 82 thus forming as shown in FIG. 6B T-shaped walls associated with a base 80. Such a T-shaped structure permits entirely rigidifying especially the vertical wall 81 at the base 80. It is clear that, for a sufficient length of vertical wall 81, it is necessary to provide a plurality of webs 82 spaced from one another at a predetermined distance. Under these conditions, such a support wall may not have enough flexibility to be able to absorb the rotary deformations as described previously. There is thus produced a support wall as illustrated in FIG. 6A, in the base 83 of the web 82 of which is produced a part 84 of a destructible material, this material being in contact with the surface 85 of the base 80. It will be understood that the base 80 and the part 86 of the web 82, as well as the wall 81, are interconnected by iron bracings as illustrated schematically at 87, as is well known in the production of reinforced concrete wall.

Nevertheless, near this web 82 is provided, in the vertical wall 81, an opening 88 sufficiently large so as to be able to accommodate a tool and, if desired, as described hereinafter, to destroy the lower part 84 of the web 82, the part produced from a destructible material, as mentioned above.

After having erected a support wall 10 as shown in FIG. 6, the stacking of layers 15 as described especially with regard to FIG. 3 is effected.

Referring now to FIG. 7, it can be seen that the lower part of the web 82 which had been in contact with the base 80 has been destroyed, especially if it is made from a hard polymerizable resin by means of a blow torch which caused it to fuse. Moreover, the assembly iron 89 of the group of assembly irons 87 which connect the web 82 to the base 80, passing through the destructible lower portion 84, is also cut away by the blow torch through opening 88, so as to be able to deteriorate the connection between the web 82 and the base 80. Once this operation is effected, there no longer exists any other connection between the upper part of the web and the base, than that provided by the lower longitudinal portion 90 of the lateral wall 81 of the support wall 10. This wall 81, especially by its base 90, is situated in a plane which is parallel to the plane 17 passing through the lateral edge of the stack of layers 15. As the shear forces are exerted perpendicular to this plane and as the lateral wall 81 has a slight thickness, the lower part 90 thus plays the role of a wedge and thus permits the upper portion of the wall to be subjected to flexure deformations in the two directions shown by arrows 91 and 92, and thus to absorb the deformations as described above.

It will be understood that the destruction operation of the base 84 of the web 82 and of the portion of the assembly iron passing through this base 84 are effected after the end of manufacture of the stack of layers 15 and the construction of the road 7.

Finally, it has been shown that, so as to produce the stack of layers 15, it was necessary to produce a casing 41 which would bear against the interior wall of the support wall and, more particularly, that the position of the plate 43 of the casing would take reference with respect to the support wall by means of two wedge assemblies slidable with respect to one another, so as to be able entirely to maintain, for a position of the two assemblies, the element 43 and thus perfectly to define the position of the vertical border of the layers 15.

FIG. 8 shows, in a relatively simplified view, an advantageous embodiment of the wedge means 45 shown schematically in FIGS. 4A and 4B. It is stated above all that by "wedging means" it is intended "any means permitting positioning two reference surfaces substantially parallel by means of forces which may have any direction with respect to these parallel surfaces".

The embodiment of the wedging means illustrated in FIG. 8 comprises two reference surfaces defined respectively by the opposed surfaces, respectively plate 43 and counterplate 143. This plate and counterplate are associated by means of a deformable pentagram defining four apexes of a parallelogram. In this embodiment illustrated, the pentagram 110 is constituted by two lever arms 111 and 112 pivotally connected at their middles about an axis 113. The extremities of these two lever arms are rotatively and slidably mounted on the plate and counterplate. The sliding extremities cooperate with this plate and counterplate, for example by means of pins housed in grooves 115.

Two extremities, respectively of the two lever arms, cooperating with one of the plate o;f counterplate are connected by a controllable jack 114, so as to be able to rotate these two lever arms with respect to one another and thus drive the displacement of the plate with respect to the counterplate.

So as to produce the layers, one proceeds as described above, by positioning the counterplate 143 on the support wall 10, or if desired a scaffolding provided to this end, and acting on the jack 114 to bring the plate to the desired position. The layer 15 is then produced as described above. Once this is finished, the jack 114 is again controlled to bring together the plate 43 and counterplate 143 and thus to be able to liberate these wedging means for using them again, for the production of a subsequent layer.

A jack has been described above as displacement means for the plate with respect to the counterplate. However, it is possible to replace this means by two means each having their own function, for example: on the one hand a plurality of expandable pneumatic cushions disposed between the plate and the counterplate to obtain their relative separation and, on the other hand, an adjustment spring situated between the two lever arms to obtain the drawing together of the plate and the counterplate when the pneumatic cushions are deflated.

I claim:

1. Support structure adapted to be erected on a relatively horizontal ground surface, comprising:

a stack of layers (15) of loose material, said layers being disposed on top of one another, a flexible envelope (16) at least partially surrounding each said layer (15), each said envelope defining a border (18) situated substantially in a first substantially vertical plane (17), and a support wall (10) disposed on the said ground surface (5, 9) and extending substantially parallel to said first vertical plane (17), said wall having a portion extending vertically upwardly beyond said stack, wherein said wall is disposed at a predetermined distance from said stack so as to define a free space (20) between said vertical plane and said support wall (10).

2. Structure according to claim 1, said support wall (10) comprises a base (11) bearing on the said ground surface, said stack resting on a part (14) of said base (11).

3. Structure according to claim 1, wherein said support wall (10) comprises substantially at said portion extending vertically upwardly beyond said stack a table (22) and at least one support plate (24) having two extremities (25, 26) resting respectively on said table (22)

and said stack, said support plate (24) being situated above said free space (20).

4. Structure according to claim 3, wherein said two extremities (25, 26) of said support plate (24) comprise substantially rounded edges.

5. Structure according to claim 3 further comprising an upper layer (31) covering said stack and said support plate (24), said upper layer extending to said support wall (32, 10).

6. Structure according to claim 5, and connection means (29) interconnecting said support wall and said stock.

7. Structure according to claim 6, wherein said connecting means comprises a link (29) having a first extremity fixed to said portion of said support wall (10) extending vertically upwardly beyond said stack, and a second extremity grippingly confined between said stack and said upper layer (31).

8. Structure according to claim 1, comprising webs (13) disposed in said free space (20) and in a second plane substantially perpendicular to said first plane, said webs (13) being fixed at least to said support wall.

9. Process for production of a support structure according to claim 1, comprising:

preparing a said ground surface (5, 9) substantially horizontal, positioning a said support wall (10) on said ground surface, successively disposing said layers (15) to form a said stack and define a said free space (20) with respect to said support wall (10).

10. Process according to claim 9, wherein said successive disposition of said layers (15) comprises:

positioning a casing plate (43), for the production of a single said layer (15), with respect to the said wall (10), said casing plate having at least one wedge assembly (45), said plate (43) having a surface (44) situated substantially coplanar with said first vertical plane (17) in which are disposed said borders (18) of the said layers when they are produced, unrolling, on each said layer, material forming said envelope (40, 51), and mounting said material along said plate (43), disposing said loose material to a level passing substantially through the upper level of said plate (43), unrolling surplus (46, 146) said material onto an underlying said layer when a desired height of said underlying layer is attained.

unwedging said casing plate (43), then subjecting it to a translation along said support wall (10) so as to bring it in a position above said layer (15) under production, so as to effect a subsequent said layer (15).

11. (amended) Process according to claim 10, wherein said positioning of said support wall comprises:

erecting a said support wall (10) comprising webs (13) and a base (11) resting on said ground surface, said webs (13) being fixed to said base and to said wall, and thereafter disengaging said webs from said base when said disposing of said layers is complete.

12. Process for production of a support structure, comprising:

preparing a substantially horizontal foundation (5, 9), positioning a reference plate (12) on said foundation, said reference plate forming with respect to said foundation a right angle, successively disposing layers (15) by stacking with respect to said reference plate (12), wherein each said layer (15) is produced by steps comprising:

positioning a casing plate (43) with respect to the said reference plate (12) by means of a wedge assembly (45), said plate (43) having a surface (44) turned toward said layers and situated facing said layers, unrolling, on said foundation or a said layer, a flexible envelope material (40, 51, . . . ) and mounting said material along said plate (43), disposing loose material on said flexible envelope material and coextensive with said surface (44) of plate (43), unrolling surplus (46, 146) said flexible material on an underlying said layer when a desired height of said underlying layer is attained, and undweding said casing plate (43), and subjecting same to a vertical translation along said stack for bringing it into a position above said underlying layer (15), so as to produce a subsequent said layer (15).

* * * * *